US009212810B2

(12) United States Patent
Hisano et al.

(10) Patent No.: US 9,212,810 B2
(45) Date of Patent: Dec. 15, 2015

(54) LIGHTING APPARATUS

(75) Inventors: Katsumi Hisano, Matsudo (JP); Mitsuaki Kato, Kawasaki (JP); Tomoyuki Suzuki, Yokohama (JP); Tomonao Takamatsu, Kawasaki (JP); Tetsuya Kugimiya, Kawasaki (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 165 days.

(21) Appl. No.: 13/404,235

(22) Filed: Feb. 24, 2012

(65) Prior Publication Data

US 2012/0218768 A1 Aug. 30, 2012

(30) Foreign Application Priority Data

Feb. 28, 2011 (JP) ..... 2011-043040

(51) Int. Cl.

| | |
|---|---|
| ***F21V 29/00*** | (2015.01) |
| ***F21K 99/00*** | (2010.01) |
| ***F21V 29/74*** | (2015.01) |
| ***F21V 29/77*** | (2015.01) |
| ***F21V 29/83*** | (2015.01) |

(Continued)

(52) U.S. Cl.

CPC ..... *F21V 29/004* (2013.01); *F21K 9/135* (2013.01); *F21V 29/74* (2015.01); *F21V 29/773* (2015.01); *F21V 29/83* (2015.01); *F21V 29/89* (2015.01); *F21V 3/00* (2013.01); *F21Y 2101/02* (2013.01); *F21Y 2105/001* (2013.01)

(58) Field of Classification Search

CPC ..... F21V 29/004; F21V 29/22; F21V 3/02; F21V 29/2206; F21V 29/2231; F21V 29/2218

USPC ..... 362/650, 311.01–311.02, 361, 363, 373

See application file for complete search history.

(56) References Cited

U.S. PATENT DOCUMENTS

| | | | | |
|---|---|---|---|---|
| 2009/0046473 | A1* | 2/2009 | Tsai et al. | 362/373 |
| 2010/0165632 | A1* | 7/2010 | Liang | 362/294 |

(Continued)

FOREIGN PATENT DOCUMENTS

| | | | |
|---|---|---|---|
| CN | 101368719 | A | 2/2009 |
| JP | 2006-310057 | A | 11/2006 |

(Continued)

OTHER PUBLICATIONS

First Office Action dated Feb. 5, 2013 for corresponding Japanese Patent Application No. 2011-043040 with English translation (6 pages).

(Continued)

*Primary Examiner* — Diane Lee
*Assistant Examiner* — Gerald J Sufleta, II
(74) *Attorney, Agent, or Firm* — Ohlandt, Greeley, Ruggiero & Perle, L.L.P.

(57) ABSTRACT

According to one embodiment, a lighting apparatus includes a board, a base, a globe, a housing, and a cap part. The board is provided with a light emitting element to emit light. The board is thermally connected to the base. The globe is provided on the base to cover the light emitting element. The globe includes a maximum diameter part in which an external diameter of the globe is maximum. The housing is thermally connected to the base. The housing includes a cylindrical radiator through which air flows. The cap part is attached to the housing. One end part of the radiator is located between the cap part and the maximum diameter part.

14 Claims, 19 Drawing Sheets

(51) Int. Cl.

| | |
|---|---|
| ***F21V 29/89*** | (2015.01) |
| *F21V 3/00* | (2015.01) |
| *F21Y 101/02* | (2006.01) |
| *F21Y 105/00* | (2006.01) |

(56) References Cited

U.S. PATENT DOCUMENTS

| | | | | |
|---|---|---|---|---|
| 2010/0289396 | A1* | 11/2010 | Osawa et al. | 313/46 |
| 2011/0170294 | A1* | 7/2011 | Mier-Langner et al. | 362/294 |
| 2013/0154465 | A1* | 6/2013 | Anderson | 313/45 |

FOREIGN PATENT DOCUMENTS

| | | | |
|---|---|---|---|
| JP | 2009048994 | A | 3/2009 |
| JP | 2009-093926 | A | 4/2009 |
| JP | 2009-267082 | A | 11/2009 |
| JP | 2010108774 | A | 5/2010 |
| JP | 2010157506 | A | 7/2010 |
| JP | 2010192406 | A | 9/2010 |
| JP | 3163765 | U | 10/2010 |
| JP | 3164033 | U | 10/2010 |
| JP | 2011034958 | A | 2/2011 |

OTHER PUBLICATIONS http://www.weet.co.kr/Front_jp/indoor/wth_6.asp; Hyndai Telecom; WTH-8; 2009; 1 page with Concise Explanation.

http://www.cens.com/cens/html/en/product/product_main_95620.html; OPCOM L500M6-PAR30; 1 page with Concise Explanation.

First Chinese Office Action dated Feb. 27, 2014, 15 pages.

* cited by examiner

LIGHTING APPARATUS

CROSS-REFERENCE TO RELATED APPLICATIONS

This application is based upon and claims the benefit of priority from prior Japanese Patent Application No. 2011-043040, filed Feb. 28, 2011, the entire contents of which are incorporated herein by reference.

FIELD

Embodiments described herein relate generally to a lighting apparatus including a light emitting element such as an LED.

BACKGROUND

LED light bulbs which use, as a light source, a light emitting diode (LED) corresponding to a semiconductor light emitting element have been used as lighting apparatuses that replace incandescent light bulbs. In LED light bulbs, a board on which an LED is mounted is attached to a metal base, a surface of the base on the light source side is covered with a translucent globe, and a surface of the base on the opposite side is provided with a housing which has a thermally radiative structure. A cap is provided at one end of the housing. In the cap, a power source circuit which supplies electric power to the LED is provided. In LED light bulbs having the above structure, heat is radiated mainly from the external surface of the housing. There are LED light bulbs in which a number of fins are provided on the external surface of the housing to improve thermally radiative performance.

However, it is difficult for thermal radiation from the external surface of the housing to suppress an increase in temperature of LEDs which radiate a greater amount of heat. When the housing is formed of a material which has high thermal conductivity to improve thermally radiative performance, the power source circuit is held in the housing, thus the temperature of the power source circuit increases, and there is a risk that the power source circuit may be destroyed by heat.

In addition, there are LED light bulbs which have fins which project radially from the external surface of the housing. The LED light bulbs have high thermally radiative performance, but instead are larger than regular incandescent light bulbs. Therefore, such LED light bulbs cannot be used instead of incandescent light bulbs, and have only limited uses. In addition, since the projecting fins block light from LEDs, and thus the luminous intensity distribution angle of the light bulbs are limited.

DETAILED DESCRIPTION

In general, according to one embodiment, a lighting apparatus includes a board, a base, a globe, a housing, and a cap part. The board is provided with a light emitting element to emit light. The base has a first surface and a second surface. The board is attached to the first surface to be thermally connected to the base. The globe is provided on the base to cover the light emitting element and configured to transmit the light. The globe includes a maximum diameter part in which an external diameter of the globe in a radial direction is maximum. The radial direction is a direction perpendicular to a central axis of the lighting apparatus. The housing is attached to the second surface to be thermally connected to the base. The housing includes a cylindrical radiator having a first end part and a second end part which are opened such that air flows through the radiator. The first end part is arranged opposite to the second surface to provide a first opening between the first end part and the second surface. The cap part is attached to the housing and arranged opposite to the second end part to provide a second opening between the cap part and the second end part. The first end part is located between the cap part and the maximum diameter part.

The lighting apparatus of the embodiment can suppress an increase in temperature of the light emitting element and the power source circuit which supplies electric power to the light emitting element. Further, the lighting apparatus of the embodiment realizes broad luminous intensity distribution.

Hereinafter, lighting apparatuses according to embodiments will be described with reference to the accompanying drawings. In the embodiments, like reference numbers denote like elements, and duplication of explanation will be avoided.

(First Embodiment)

Figure 1:
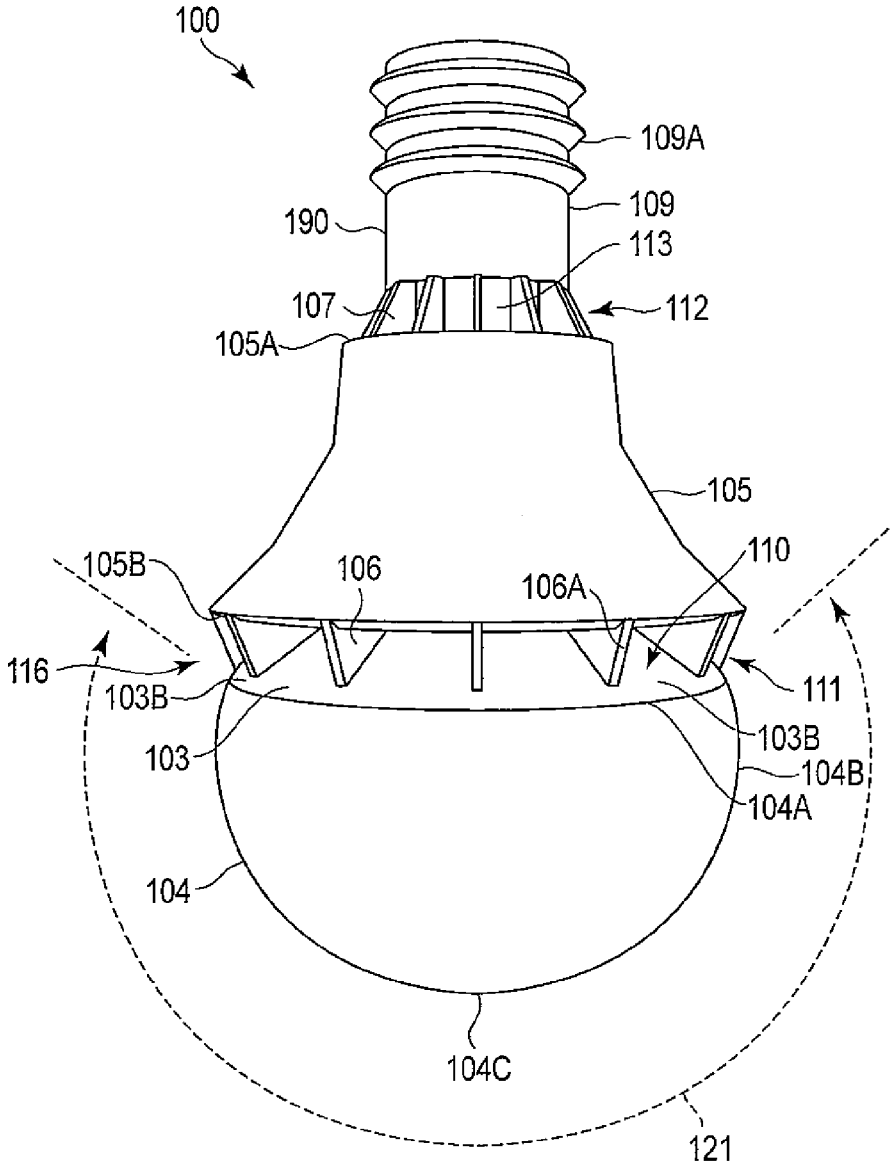
FIG. 1 is a schematic plan view of an external appearance of a lighting apparatus according to a first embodiment.
Figure 2:
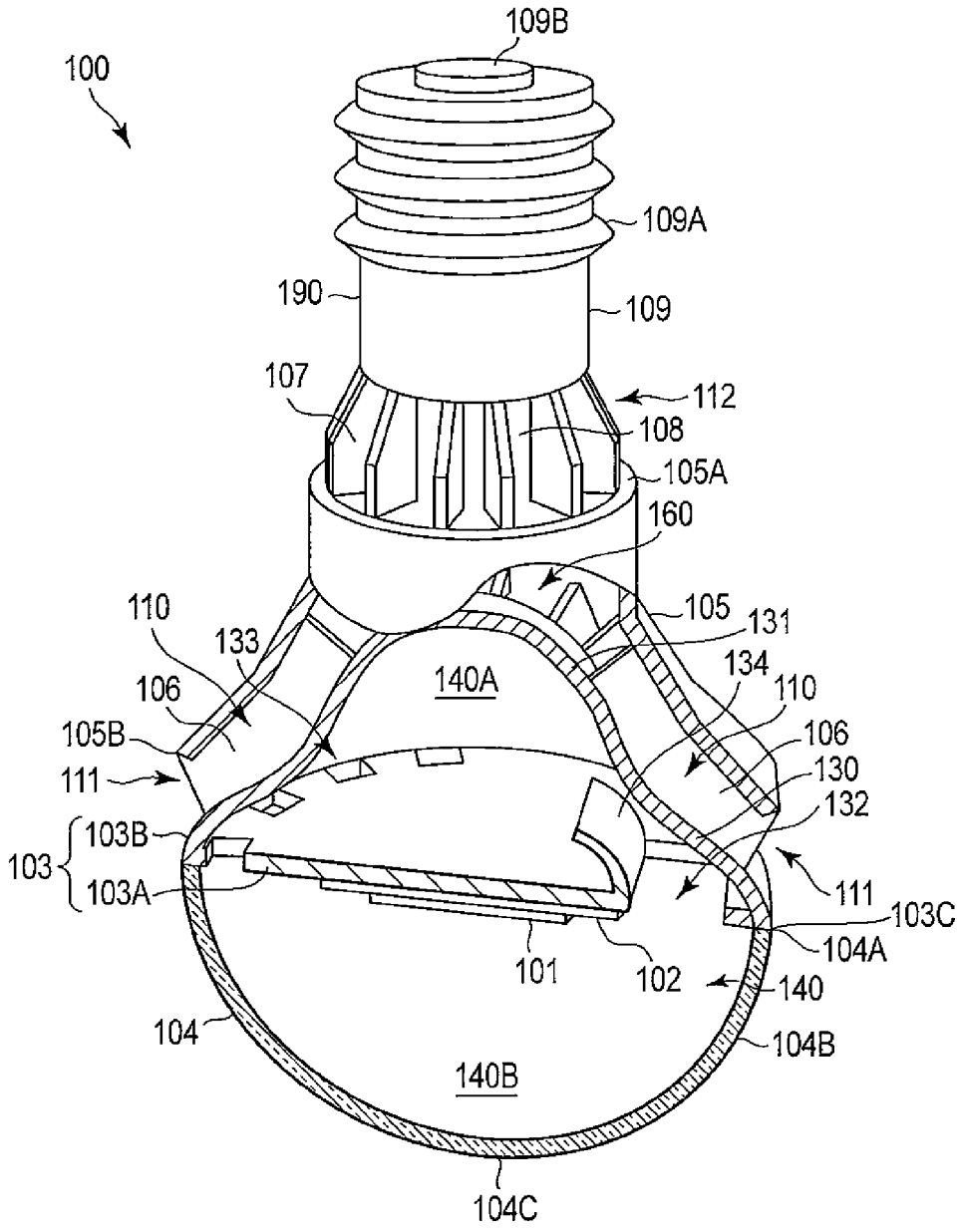
FIG. 2 is a schematic perspective view of the lighting apparatus of FIG. 1, part of which is cut off.
Figure 3:
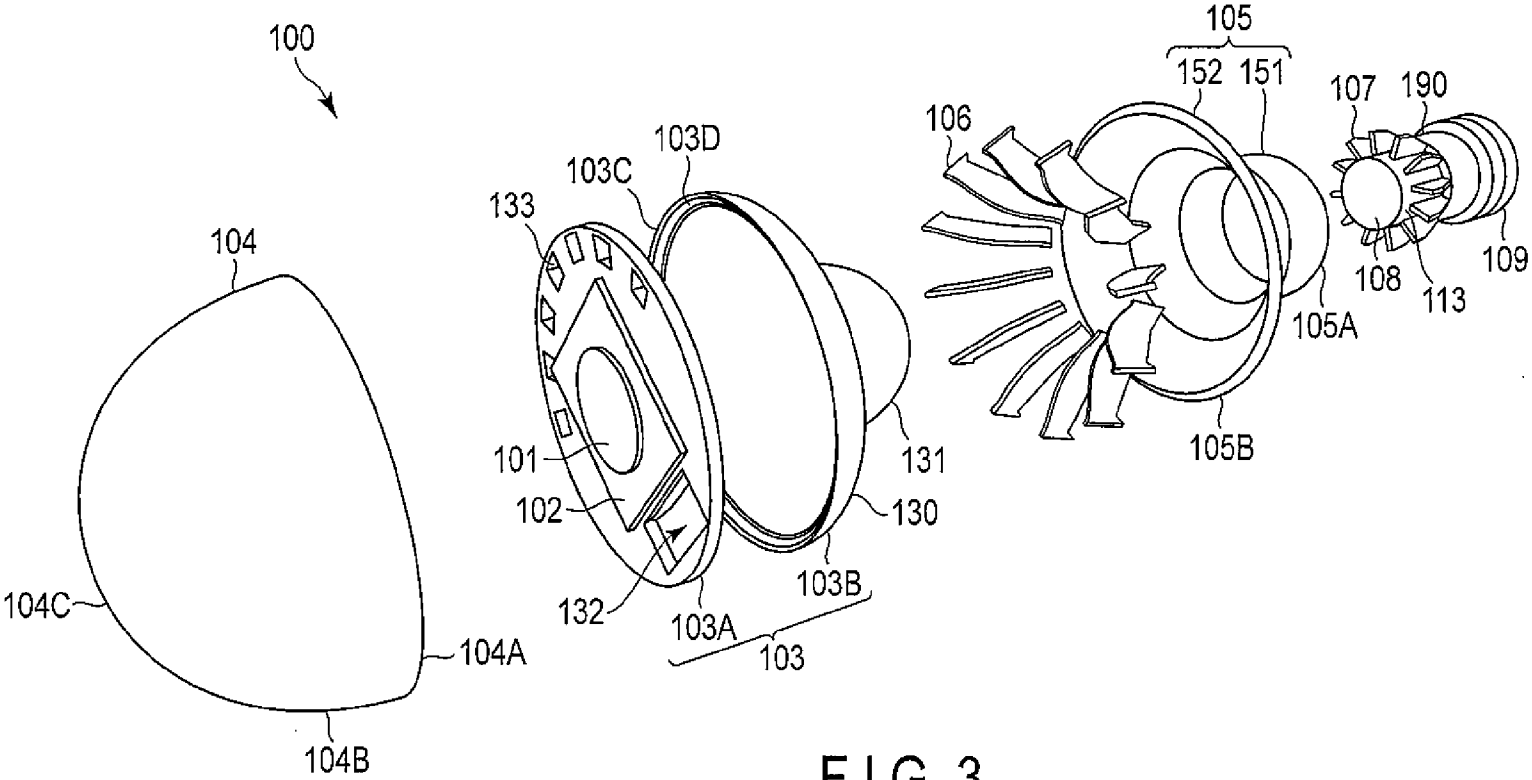
FIG. 3 is a schematic exploded perspective view of the lighting apparatus of FIG. 1.

FIG. 1 is a schematic plan view of an external appearance of a lighting apparatus 100 according to a first embodiment, and FIG. 2 is a schematic perspective view of an internal structure of the lighting apparatus 100, part of which is cut off. FIG. 3 is an exploded perspective view of the lighting apparatus 100. As illustrated in FIG. 2, the lighting apparatus 100 includes a light emitting element 101, and the light emitting element 101 is mounted to a board 102 formed of metal or ceramics. The light emitting element 101 includes a light emitting diode (LED) serving as a light source, and produces or emits visible light, for example, white light. As an example, the light emitting element 101 is formed of an LED which produces bluish-purple light having a wavelength of 450 nm, and a fluorescent material which absorbs the bluish-purple light from the LED and produces yellow light having a wavelength around 560 nm in combination, and thereby the light emitting element 101 produces white light. Although FIG. 2 illustrates one light emitting element 101, a plurality of light emitting elements may be provided on the board 102.

The board 102 has a thin plate shape which has first and second main surfaces that are opposed to each other. The light emitting element 101 is arranged on the first main surface. The board 102 is attached to a board attaching part 103A of a base 103, such that the second main surface is opposed to a first surface of the board attaching part 103A. A sheet (not shown) is provided between the board 102 and the board attaching part 103A, to reduce contact thermal resistance between the board 102 and the base 103. The board 102 is thermally connected with the base 103 via the sheet, in a state where contact thermal resistance between them is kept small. In addition, the sheet functions as an insulating layer which electrically insulates the board 102 from the base 103.

The base 103 is formed of the board attaching part 103A and an exposed part 103B. The base 103 is formed of metal which has good thermal conductance, such as aluminum. The board attaching part 103A is formed in a disk shape. The exposed part 103B is formed in an almost hemispherical shape. More specifically, the exposed part 103B includes a dome part 130 which has a dome shape, and a projecting part 131 which projects outward from the center of the outer circumference of the dome part 130. As illustrated in FIG. 3, a fitting groove 103D is formed in an internal circumferential surface of an edge part 103C of the exposed part 103B. The board attaching part 103A in a state of being fitted into the fitting groove 103D is fixed to the exposed part 103B.

The edge part 103C of the exposed part 103B is provided with a globe engagement mechanism (not shown), and a globe 104 is engaged with the base 103 by the globe engagement mechanism. The globe 104 may be fixed to the base 103 by adhesive or the like. The globe 104 is formed of a light-transmitting material, such as glass or synthetic resin. As an example, the globe 104 is formed of milky-white polycarbonate to diffuse light. As another example, the globe 104 is formed of translucent acrylic resin, and has light diffusion property obtained by minute depressions and projections formed on an internal surface thereof by sandblast. The globe 104 is provided to cover the light emitting element 101, and has a smooth curved shape which is similar to a silhouette of a ball part of an ordinary incandescent light bulb. Specifically, as illustrated in FIG. 1, the diameter of the globe 104 is gradually increased from an edge part 104A connected to the base 103 toward a maximum diameter part 104B, and gradually reduced from the maximum diameter part 104B toward an end part 104C. The edge part 104A of the globe 104 has the same external diameter as the external diameter of the edge part 103C of the exposed part 103B, and the external surface of the globe 104 and the external surface of the exposed part 103B form a smooth curved surface.

As illustrated in FIG. 2, an enclosed space 140 is defined by the exposed part 103B and the globe 104. The enclosed space 140 is divided into two separated spaces 140A and 140B by the board attaching part 103A. One separated space 140A is defined by the board attaching part 103A and the exposed part 103B. The other separated space 140B is defined by the board attaching part 103A and the globe 104. The light emitting element 101 is located in separated space 140B. These separated spaces 140A and 140B communicate with each other through opening parts 132 and 133 which are provided in the board attaching part 103A. The opening part 133 is provided in a circumferential edge part of the board attaching part 103A, and the opening part 132 is provided closer to the board 102 than the opening part 133 is.

The exposed part 103B is attached to a radiator 105 through a plurality of ribs 106, such that the exposed part 103B is apart from the radiator 105. The radiator 105 is formed in an almost cylindrical shape, in which both end parts 105A and 105B are opened. Specifically, as illustrated in FIG. 3, the radiator 105 includes a cylindrical part 150 which has a cylindrical shape having an almost fixed diameter, and an enlarged cylindrical part 151 which has a diameter that is gradually enlarged from the cylindrical part 150 toward the exposed part 103B to agree with the shape of the exposed part 103B. The external diameter of the end part 105B of the enlarged cylindrical part 151 is set to a size which does not block light which has been transmitted through the globe 104, preferably a size which is not larger than the external diameter of the maximum diameter part 104B, in which the external diameter of the globe 104 is maximum.

The ribs 106 are apart from each other, and radially arranged along the external circumferential surface (or second surface) of the exposed part 103B and the internal circumferential surface of the enlarged cylindrical part 151. A plurality of channels 110, through which air flows or circulates, are defined by the ribs 106, the external circumferential surface of the exposed part 103B, and the internal circumferential surface of the enlarged cylindrical part 151. These channels 110 are provided in parallel inside the radiator 105, such that they extend along a direction from the dome part 130 to the projecting part 131. One or more opening parts 111 are defined by the end part 105B of the enlarged cylindrical part 151 and respective one end parts 106A of the ribs 106. Air flows into, or flows out of, the channels 110 through the opening parts 111. The end part 105B of the radiator 105 is located closer to the globe 104 than an end part of the projecting part 131 is.

Each of the ribs 106 has a flat plate shape in order not to prevent the flow of air by natural convection, and to increase the surface area in order to function as a thermally radiative fin. Each of the ribs 106 and the radiator 105 is formed of a material which has high thermal conductivity and excellent thermally radiative performance, such as metal and ceramics. The ribs 106 may be integrally formed with the base 103 or the radiator 105.

The lighting apparatus 100 also includes a cap 109 which is used for electrically and mechanically connecting the lighting apparatus 100 to a socket (not shown). The cap 109 includes a shell part 109A which includes a screw thread that is detachably fitted into a socket, and an eyelet part 109B which is provided at one end of the shell part 109A with an insulating part (not shown) interposed therebetween. The cap 109 is electrically connected to a power source circuit 108 through a wire (not shown). The power source circuit 108 is contained in a cylindrical housing case 113 which has a cavity inside.

FIG. 3 and other drawings illustrate the power source circuit 108 in a state of being contained in the housing case 113. The housing case 113 is attached to the cap 109. The housing 113 is electrically insulated from the cap 109. The power source circuit 108 is electrically connected to the light emitting element 101 by a wire (not shown). In the embodiments, the power source circuit 108, the housing case 113, and the cap 109 are also referred to together as a cap part 190.

An external circumferential surface of the housing case 113 is provided with a plurality of spacers 107 which extend along a direction of an axis (which corresponds to the central axis of the lighting apparatus 100) that imaginarily connects a base end part (eyelet part 109B) of the cap 109 with the end part 104C of the globe 104. In the embodiments, the axis which connects the base end part of the cap 109 with the end part 104C of the globe 104 is referred to as a central axis, and a direction perpendicular to the central axis is defined as a radial direction. The cap part 190 is attached to the radiator 105 through the spacers 107 in a state where the housing case 113 is apart from the radiator 105. By attaching the cap part 190 to the radiator 105 through the spacers 107, one or more opening parts 112 are formed between the housing case 113 and the radiator 105. Air flows into, or flows out of, an internal space (also referred to as internal channel) 160 of the radiator 105 through the opening parts 112. The internal channel 160 of the radiator 105 is defined by the base 103, the radiator 105, and the cap part 190, and communicates with an external space through the opening parts 111 and the opening parts 112. The housing of the lighting apparatus 100 is formed of the above radiator (housing main body) 105, the ribs 106, and the spacers 107. The housing may include the cap part 190 and the base 103.

In the present embodiment, suppose that the lighting apparatus 100 is attached to a socket provided in the ceiling or the like, for explanation. In this case, as illustrated in FIG. 1, the cap 109 is positioned on the upper side, and the globe 104 is positioned on the lower side. When the socket, to which the lighting apparatus 100 is attached, is supplied with electric power, an AC voltage is supplied to the power source circuit 108 through the cap 109. The power source circuit 108 supplied with the AC voltage supplies a constant current to the LED of the light emitting element 101. The LED of the light emitting element 101 is lit by supply of the constant current. Light emitted from the light emitting element 101 is transmitted through the globe 104 and emitted to the external space.

Heat which is incidental to lighting of the light emitting element 101 is conducted to the base 103 through the board 102, and conducted from the base 103 to the ribs 106 and the radiator 105. The heat produced by the light emitting element 101 is radiated from the exposed part 103B of the base 103, the ribs 106, and the radiator 105 to the external space and the internal channel 160 of the radiator 105. The external surface of the exposed part 103B is exposed to the open air, and serves as a thermally radiative surface which dissipates heat. Both the internal surfaces and the external surfaces of the ribs 106 and the radiator 105 are exposed to the open air, and serve as thermally radiative surfaces. The air in the internal channel 160 of the radiator 105 is heated by heat radiated from the exposed part 103B, the ribs 106, and the radiator 105. Since hot air rises by natural convection, the heated air in the internal channel 160 is discharged from the opening parts 112 on the cap 109 side to the outside of the radiator 105. On the other hand, air of relatively low temperature is introduced from the opening parts 111 on the globe 104 side into the internal channel of the radiator 105. By the air introduced from the opening parts 111 on the globe 104 side, the air in the internal channel 160 of the radiator 105 is cooled. As described above, by circulating the air through the internal channel 160 of the radiator 105, both the internal circumferential surface and the external circumferential surface of the radiator 105 contribute to thermal radiation, and thereby thermally radiative performance can be improved.

Generally, when the air in a cylindrical channel which extends in a vertical direction is heated, it is known that a strong rising air current is produced by a phenomenon called the stack effect. In an ideal state in which a loss is not considered, the flow velocity U (m/s) of the air which rises in the channel by natural convection is indicated by the following expression (1):

$$U \propto \sqrt{H \times \frac{(T_i - T_o)}{T_i}}, \tag{1}$$

where H represents a length of the channel, Ti represents the absolute temperature (K) of the air inside the channel, and To represents the absolute temperature (K) of the air outside the channel. According to the expression (1), the flow velocity U of the air which flows inside the channel is increased, by increasing the length of the channel and/or applying much heat to the air flowing into the channel to increase the internal temperature.

By effectively using the stack effect described above, more air which has relatively low temperature is introduced into the cylindrical radiator 105, and the thermally radiative performance can be further increased. Therefore, in the present embodiment, to increase the flow velocity of the air which circulates through the radiator 105, the radiator 105 is formed as long as possible. Specifically, the radiator 105 is formed to have a length which extends from the vicinity of the edge part 104A of the globe 104 to the vicinity of the end part of the cap part 190, on which the housing case 113 is located. In addition, the shapes of the exposed part 103B, the ribs 106 and the radiator 105 are determined to increase the surface areas thereof.

To use the stack effect, it is important to smoothly introduce the air into the internal channel 160 of the radiator 105. When the lighting apparatus 100 is set in a state where the cap 109 is located on the upper side, the end part 105B of the radiator 105 is located upper than the maximum diameter part 104B of the globe 104, that is, the end part 105B is located between the cap 109 and the maximum diameter part 104B. An envelope surface which is formed by the base 103, the globe part 104 and the radiator 105 has a stepped part 116 illustrated in FIG. 1. By the stepped part 116, the air which is heated by the globe 104 and rises along the external circumferential surface of the globe 104 is smoothly guided into the internal channel 160 of the radiator 105. As a result, thermal radiation in the internal channel 160 is promoted.

In addition, since the globe 104 has the shape, a diameter of which is reduced from the maximum diameter part 104B toward the edge part 104A, and the end part 105B of the radiator 105 is located between the cap 109 and the maximum diameter part 104B, the lighting apparatus 100 of the present embodiment can obtain a luminous intensity distribution angle 121 greater than 180°. The air which rises along the external circumferential surface of the globe 104 having such a shape has a velocity component in a direction of going toward the central axis, and thus the air can be introduced into the internal channel 160 of the radiator 105, even when the radiator 105 only has a projection which does not block the light from the globe 104. Specifically, although the lighting apparatus 100 has almost the same external diameter as a regular incandescent light bulb, the lighting apparatus 100 can realize both high thermally radiative performance and a wide luminous intensity distribution angle.

In addition, the housing case 113 which contains the power source circuit 108 is exposed to the air which circulates through the internal channel 160 of the radiator 105 without directly contacting the base 103 which has high temperature, and thus an increase in temperature of the power source circuit 108 is suppressed. As a result, the power source circuit 108 is prevented from being destroyed by heat, and reliability of the power source circuit 108 can be improved.

In the present embodiment, since the light emitting element 101 which is a heat source is located around the center of the enclosed space 140 that is defined by the exposed part 103B of the base 103 and the globe 104, and the separated spaces 140A and 140B communicate with each other through the opening parts 132 and 133 of the board attaching part 103A, a natural convection current is produced in the enclosed space 140. Specifically, the air in separated space 140B heated by the light emitting element 101 rises up and moves to separated space 140A through at least one of the opening parts 132 and 133 of the board attaching part 103A. In addition, the air in separated space 140A moves to separated space 140B through at least one of the opening parts 132 and 133, accompanying movement of the air to separated space 140A. For example, supposing that the board attaching part 103A is provided with no opening parts, the hot air remains in the upper part of separated space 140B, and consequently a natural convection current is not sufficiently developed in the globe 104. When the air does not circulate in the globe 104 as described above, heat from the light emitting element 101 is not easily conducted to the whole globe 104, and thus the globe 104 cannot be effectively used as a thermally radiative member. In the present embodiment, the light emitting element 101 is provided around the center of the enclosed space 140, the hot air reaches to the end part 104C of the globe 104 by air circulation produced thereby in the enclosed space 140. As a result, heat from the light emitting element 101 is conducted to the whole globe 104, and the degree of thermal radiation from the globe 104 can be increased.

In addition, the board attaching part 103A is provided with an internal fin 134. The internal fin 134 is disposed adjacent to the opening part 132. Thereby, thermally radiative performance for the air passing through the opening parts 132 and 133 is not uniform, the temperature and density of the air in separated space 140B are not uniform, and thus air circulation by natural convection in the enclosed space 140 is further promoted.

On the other hand, when the lighting apparatus 100 is set in a state where the cap 109 is located on the upper side, the air which circulates through the internal channel 160 of the radiator 105 is introduced from the opening parts 111 on the globe 104 side, and discharged from the opening parts 112 on the cap 109 side. In comparison with this, when the lighting apparatus 100 is set in a state where the cap 109 is located on the lower side, the air which circulates through the internal channel 160 of the radiator 105 is introduced from the opening parts 112 on the cap 109 side, and discharged from the opening parts 111 on the globe 104 side. In either case, since the air inlets (opening parts 111 or opening parts 112) are narrower than the internal channel 160 of the radiator 105 by the ribs 106 or the spaces 107, dirt and dust do not easily enter the internal channel 160 of the radiator 105, and consequently dirt and dust are prevented from accumulating in the internal channel 160 of the radiator 105.

As described above, according to the lighting apparatus 100 of the present embodiment, the channel 160, through which the air circulates, is provided inside the radiator 105 that is the housing main body. Thereby, the heat which is produced by the light emitting element 101 and conducted to the base 103, the ribs 106 and the radiator 105 is efficiently radiated, and thus thermally radiative performance can be increased. In addition, since the globe 104 has a shape, a diameter of which is increased from the edge part 104A toward the maximum diameter part 104B and reduced from the maximum diameter part 104B toward the end part 104C, a wide luminous intensity distribution can be realized. Besides, since the housing case 113 which contains the power source circuit 108 is exposed to the internal channel 160, an increase in temperature of the power source circuit 108 is suppressed, and consequently the power source circuit 108 is prevented from being destroyed by heat.

Figure 4:
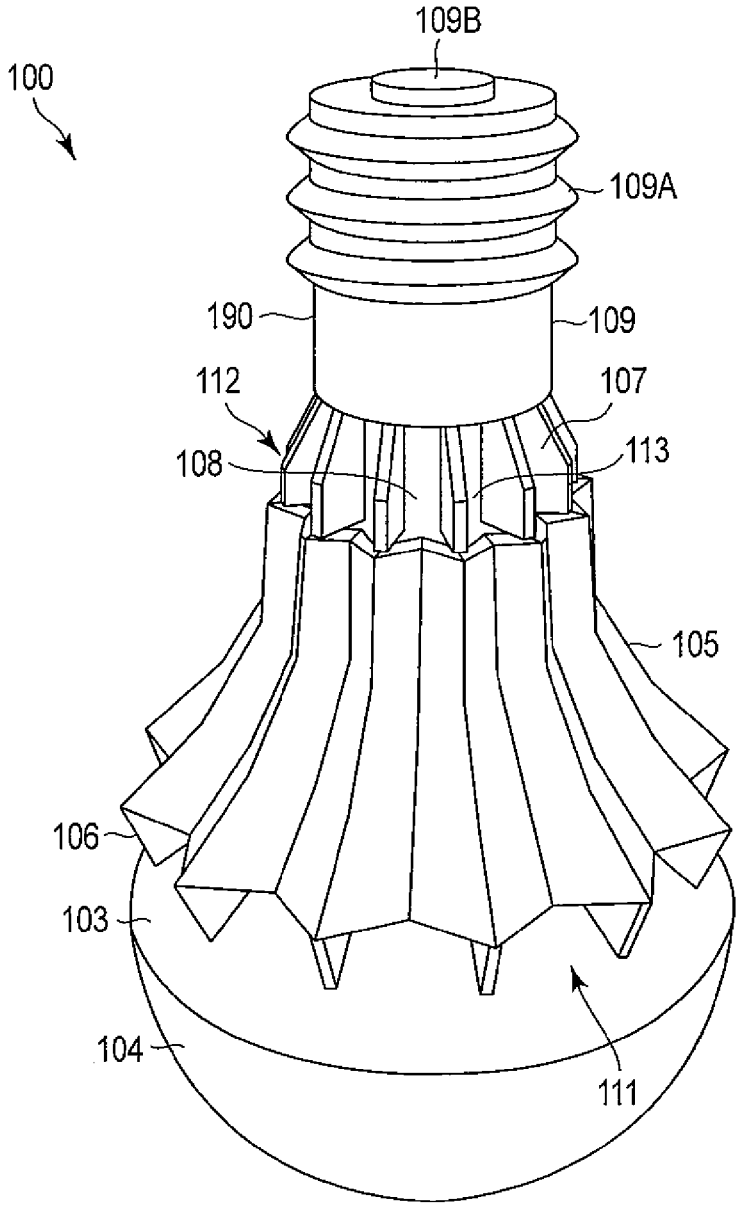
FIG. 4 is a perspective view illustrating another example of a radiator illustrated in FIG. 1.
Figure 5:
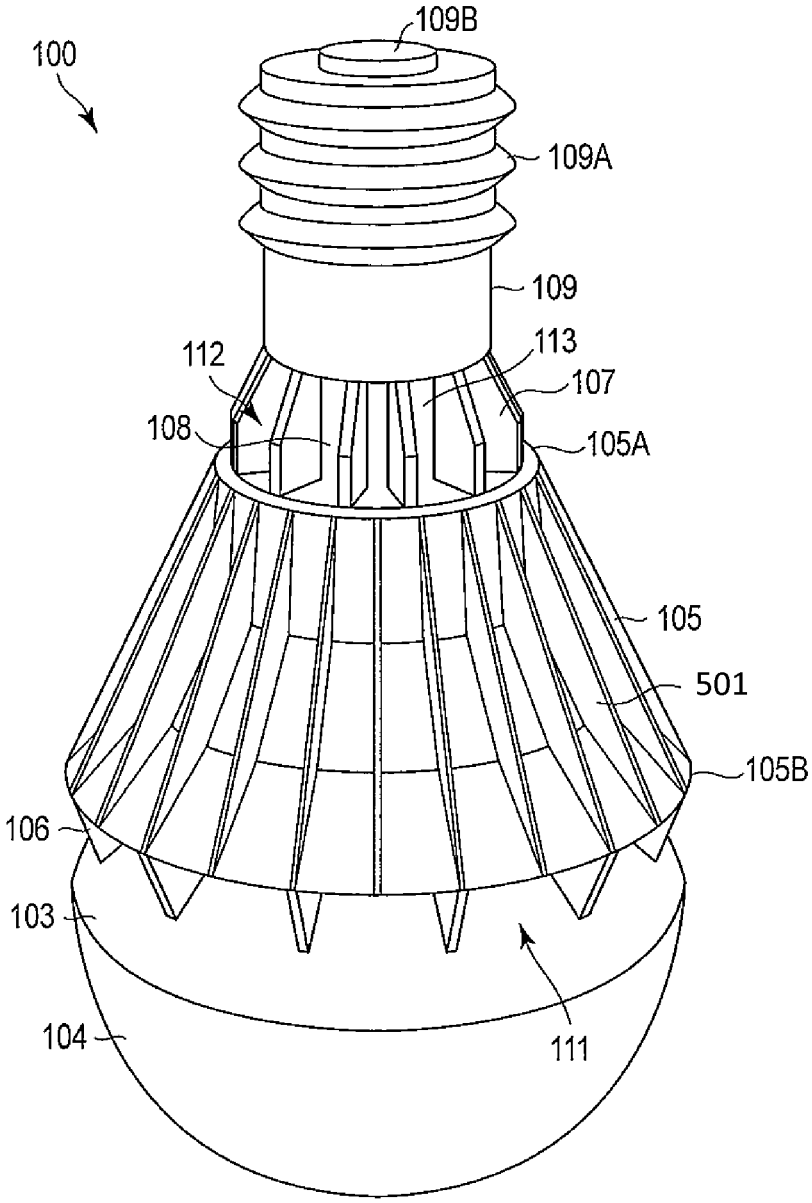
FIG. 5 is a perspective view illustrating another example of the radiator illustrated in FIG. 1.

The external shape of the radiator 105 is not limited to the example of the cylindrical shape as illustrated in FIG. 1 to FIG. 3. As an example, as illustrated in FIG. 4, the radiator 105 may have an external circumferential surface having a waved or corrugated shape. When the external circumferential surface has a waved shape, the surface area of the external circumferential surface increases, and the thermally radiative performance of the radiator 105 is further improved. In addition, the strength of the radiator 105 can be increased by adopting the waved shape, and holdability of the radiator 105 when the lighting apparatus 100 is screwed in a socket is improved. As another example, as illustrated in FIG. 5, the external circumferential surface of the radiator 105 may be provided with a plurality of thermally radiative fins 501 which extend from the end part 105A toward the end part 105B. Providing the thermally radiative fins 501 increases the surface area of the radiator 105, and further improves the thermally radiative performance of the radiator 105.

Figure 6:
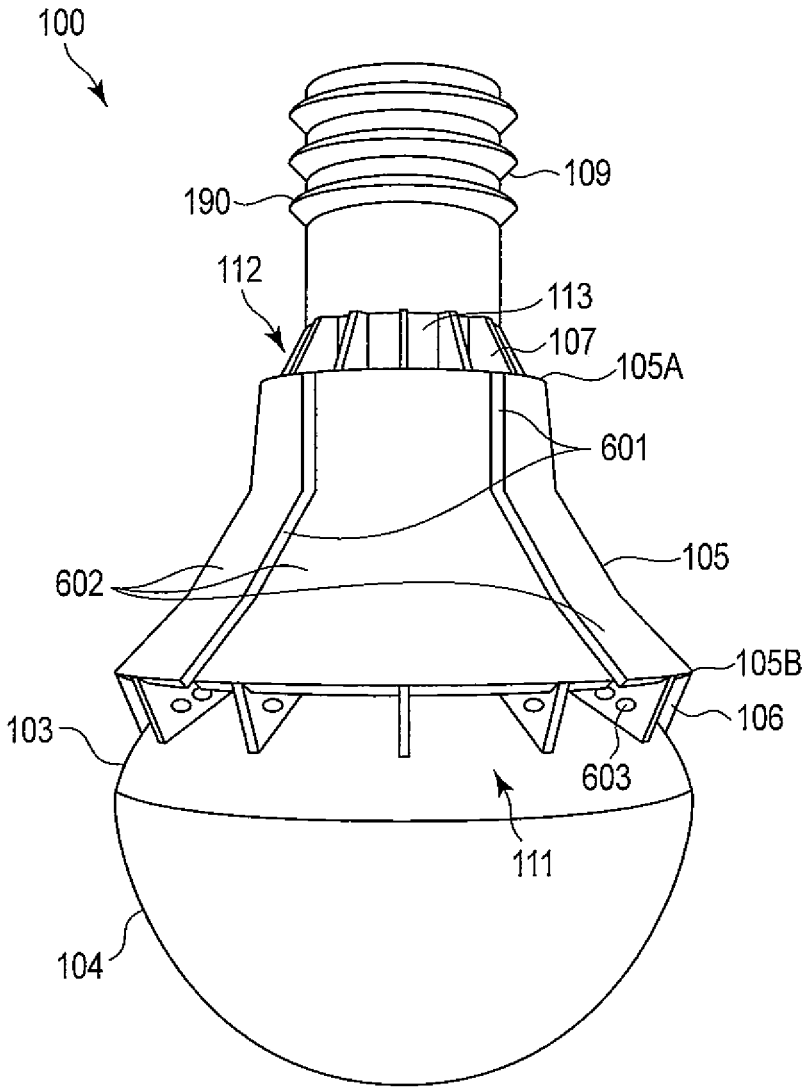
FIG. 6 is a plan view illustrating another example of the radiator illustrated in FIG. 1.

As another example, as illustrated in FIG. 6, the radiator 105 may be provided with one or more slits 601 which run along a direction going from the end part 105A toward the end part 105B. In this case, the slits 601 may be formed by forming the radiator 105 of a plurality of plate members 602 and combining the plate members 602 to be apart from each other, or slits 601 may be formed in one cylindrical member. Although the stack effect is reduced by the slits 601 provided on the radiator 105, sufficient thermally radiative performance is secured even in the case where the lighting apparatus 100 is used in a state of being held sideways. In addition, the ribs 106 may be provided with rib holes (or through-holes) 603, to prevent the ribs 106 from blocking the airflow in the internal channel of the radiator 105 when the lighting apparatus 100 is used in the state of being held sideways.

Figure 7:
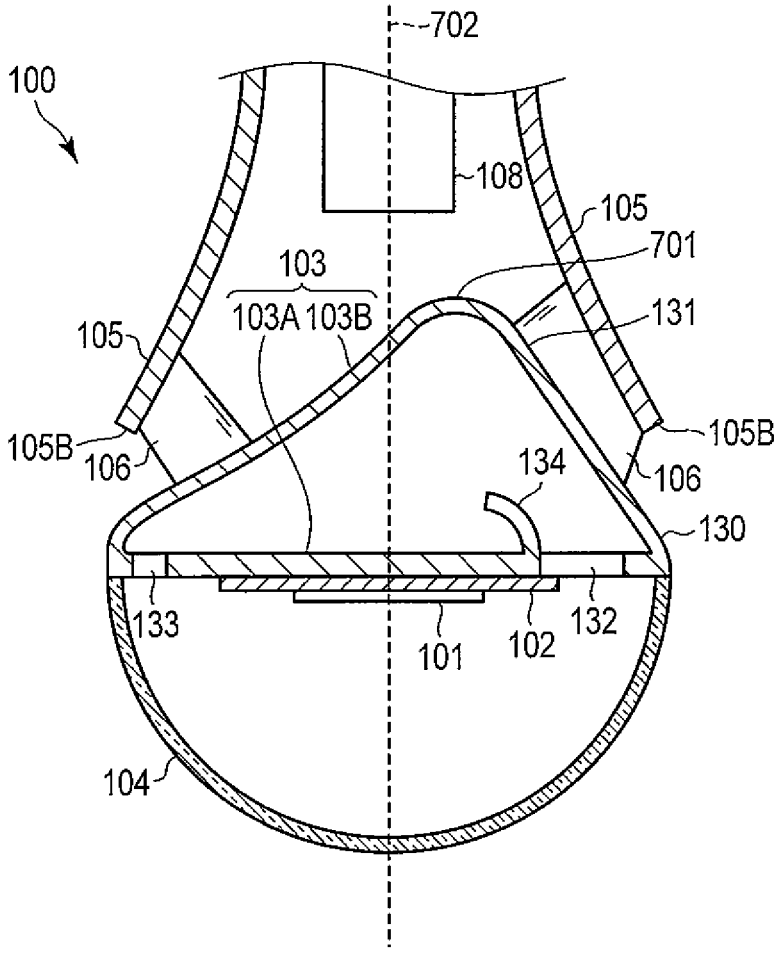
FIG. 7 is a cross-sectional view illustrating another example of a base illustrated in FIG. 1.

The exposed part 103B of the base 103 is not limited to the example of the shape which is symmetrical with respect to the central axis of the lighting apparatus 100 as illustrated in FIG. 1 to FIG. 3. As an example, as illustrated in FIG. 7, the exposed part 103B may have a shape in which a top part 701 of the projecting part 131 is shifted from the central axis 702 of the lighting apparatus 100. Also in this case, the end part 105B of the radiator 105 is located closer to the globe 104 than the top part 701 of the projecting part 131 is. Specifically, the top part 701 of the projecting part 131 is located closer to the cap 109 than the end part 105B of the radiator 105 is.

In the present embodiment, the power source circuit 108 is disposed close to the cap 109 having a small cross section, and inevitably disposed close to the central axis 702. The air which receives heat from the exposed part 103B rises along the external surface of the exposed part 103B. Therefore, the higher temperature air passes over the top part 701 of the projecting part 131. By shifting the top part 701 of the projecting part 131 from the central axis 702, the power source circuit 108 is prevented from being exposed to the hot air, and an increase in temperature of the power source circuit 108 can be further suppressed. As a result, the possibility that the power source circuit 108 is destroyed is reduced, and the reliability of the power source circuit 108 is improved. In addition, since parts included in the power source circuit 108 have different tolerable temperatures, parts which can endure high temperature are arranged in an area which is close to the top part 701 of the projecting part 131 and has high temperature, and thereby the reliability of the power source circuit 108 can be further improved.

(Second Embodiment)

Figure 8:
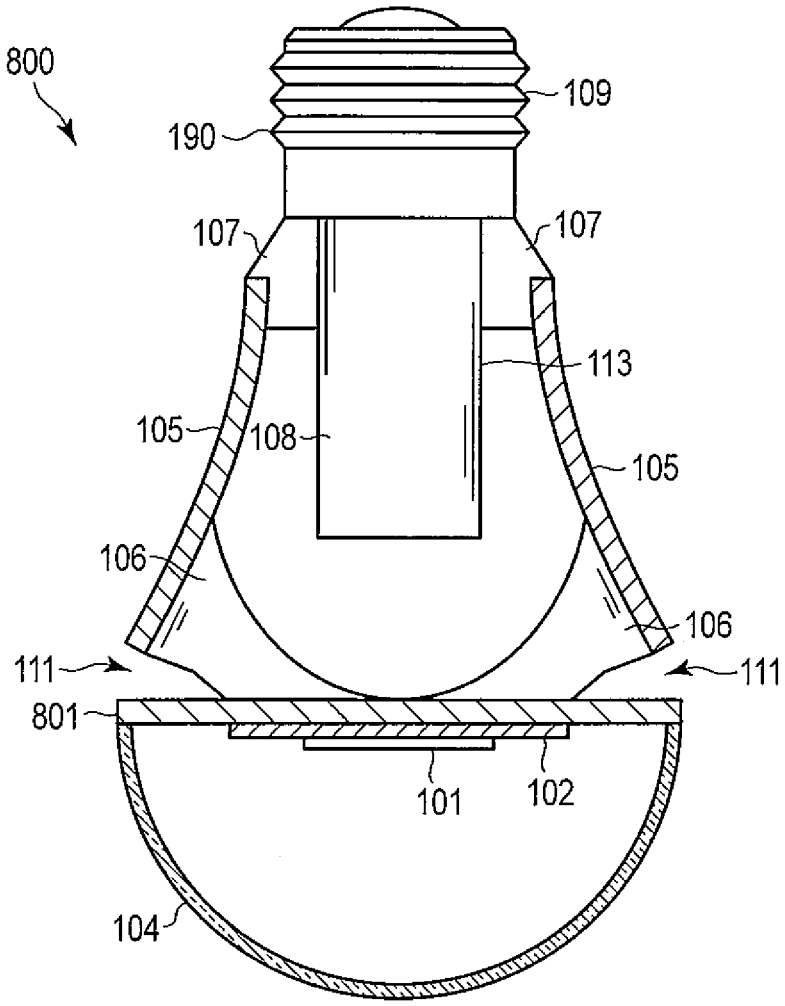
FIG. 8 is a schematic perspective view of a lighting apparatus according to a second embodiment, part of which is cut off.

FIG. 8 schematically illustrates a lighting apparatus 800 according to a second embodiment. The lighting apparatus 800 includes a base 801 which has a disk shape. The lighting apparatus 800 of FIG. 8 is different from the lighting apparatus 100 of FIG. 1 in the shape of the base, and has the same structure as that of the lighting apparatus 100 with respect to the other parts. The base 801 of the present embodiment has a first surface, to which a board 102 is attached, and a second surface, which is opposed to a first surface. In the base 801, ribs 106 are arranged on the second surface. In addition, a lower end part 105B of a radiator 105 has almost the same external diameter as an external diameter of the base 801.

In the present embodiment, natural convection is not easily produced in an enclosed space 802 which is defined by a globe 104 and the base 801, and the degree of thermal radiation by the globe 104 is reduced. However, the air circulates through an internal channel 160 of the radiator 105 in the same manner as the first embodiment, a thermally radiative surface has a large area, and thus sufficient thermally radiative performance is secured.

Figure 9:
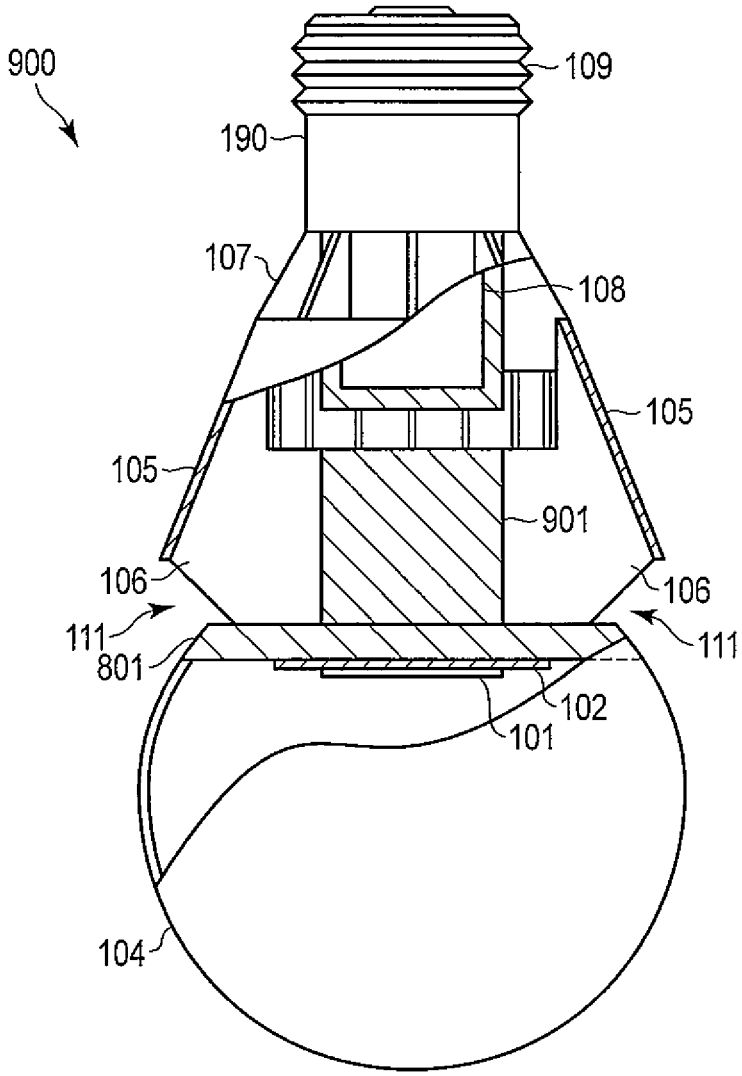
FIG. 9 is a schematic perspective view of a lighting apparatus according to a first modification of the second embodiment, part of which is cut off.
Figure 10:
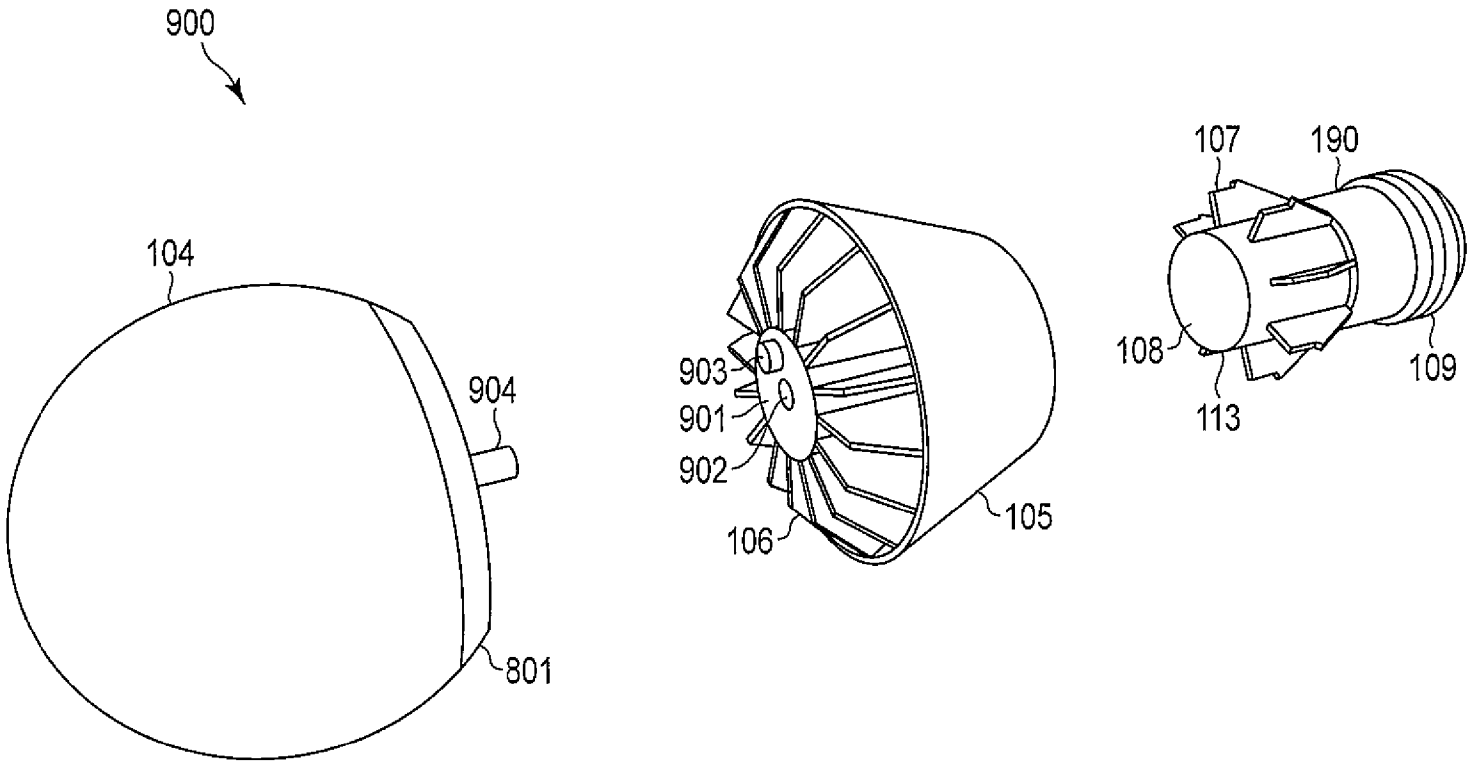
FIG. 10 is a schematic exploded perspective view of the lighting apparatus of FIG. 9.

FIG. 9 is a schematic cross-sectional view of a lighting apparatus 900 according to a first modification of the second embodiment, part of which is cut off. FIG. 10 is an exploded perspective view of the lighting apparatus 900. As illustrated in FIG. 9, the lighting apparatus 900 includes a rib shaft 901 which supports a plurality of ribs 106. When the rib shaft 901 is provided, the rib shaft 901, the ribs 106, and a radiator 105 can be formed as one unitary piece serving as a housing, as illustrated in FIG. 10.

A fitting groove 902 and a projection 903 are provided in one surface 901 of the rib shaft 901. In addition, a second surface of a base 801 is provided with a projection 904 and a fitting groove (not shown) which correspond to the fitting groove 902 and the projection 903, respectively. Positioning is performed by fitting the projection 904 of the base 801 into the fitting groove 902 of the rib shaft 901 and fitting the projection 903 of the rib shaft 901 into the fitting groove of the base 801. Thereby, the rib shaft 901 is attached to the base 801. A light emitting element 101 is disposed in the center of the first surface of the base 801, and the rib shaft 901 is disposed in the center of the second surface of the base 801. Therefore, heat produced by the light emitting element 101 is efficiently conducted to the ribs 106 and the radiator 105 through the rib shaft 901.

Besides, as illustrated in FIG. 9, there is a gap between the rib shaft 901 and the housing case 113 which contains the power source circuit 108, and the housing case 113 is connected to the radiator 105 through spacers 107. As described above, the housing case 113 does not directly contact the rib shaft 901, and heat produced by the light emitting element 101 does not easily influence the power source circuit 108.

Figure 11:
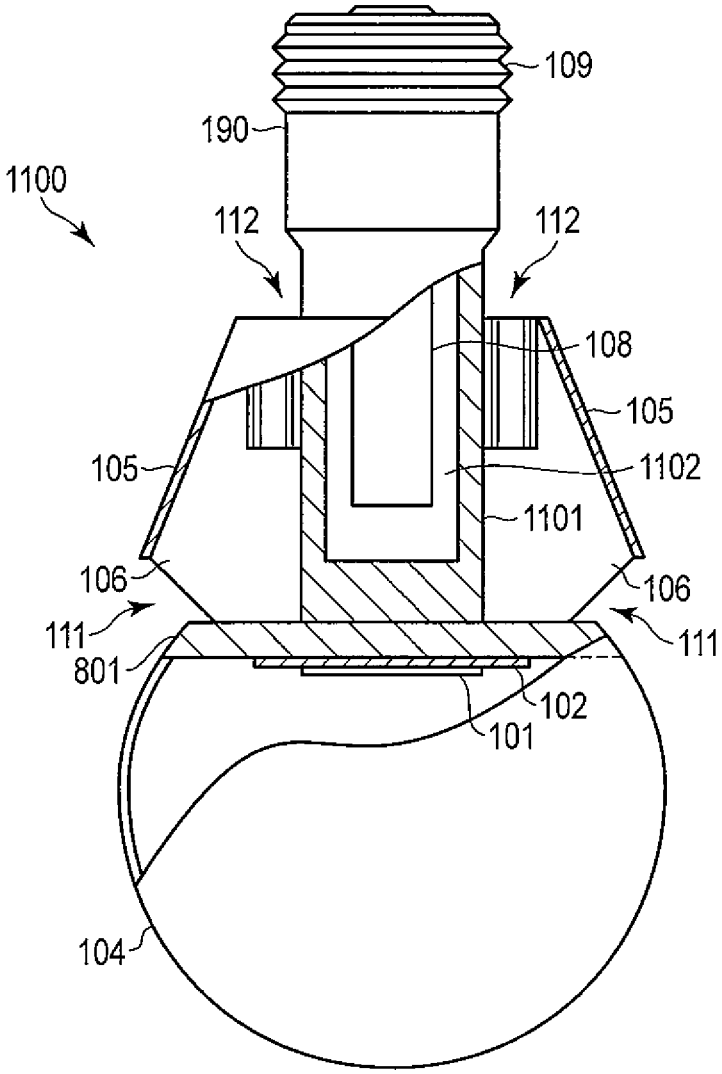
FIG. 11 is a schematic perspective view of a lighting apparatus according to a second modification of the second embodiment, part of which is cut off.

FIG. 11 schematically illustrates a lighting apparatus 1100 according to a second modification of the second embodiment. In the lighting apparatus 1100, a rib shaft 1101 which supports ribs 106 is attached to a cap part 190. The rib shaft 1101 includes a cavity part 1102 inside, and a power source circuit 108 is contained in the cavity part 1102. When the rib shaft 1101 is attached to the cap part 190, spacers 107 to support the cap part 190 are unnecessary, and thus an opening area of the opening part 112 located on the cap 109 side can be increased. As a result, air resistance to circulation is reduced, an amount of the air which circulates through the internal channel of the radiator 105, and thus thermally radiative performance is improved.

Figure 12:
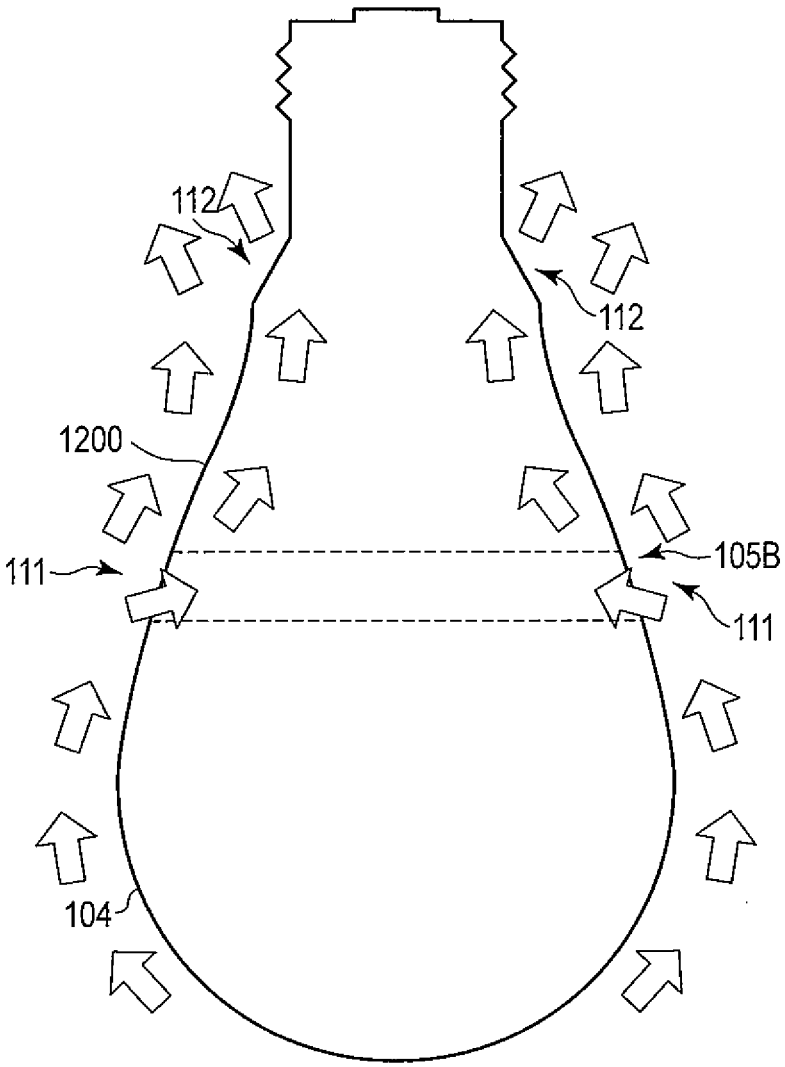
FIG. 12 is a schematic diagram of an external shape of the lighting apparatus illustrated in FIG. 8.
Figure 13:
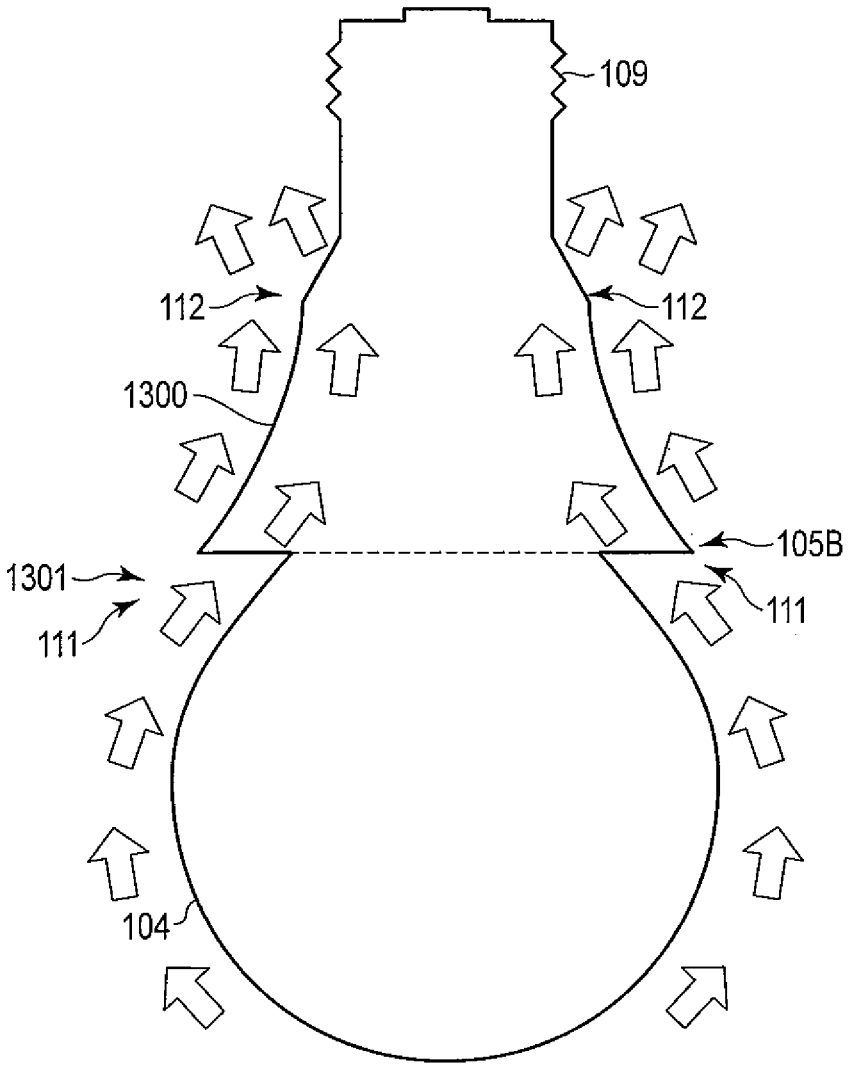
FIG. 13 is a schematic diagram of an external shape of the lighting apparatus illustrated in FIG. 1.
Figure 14:
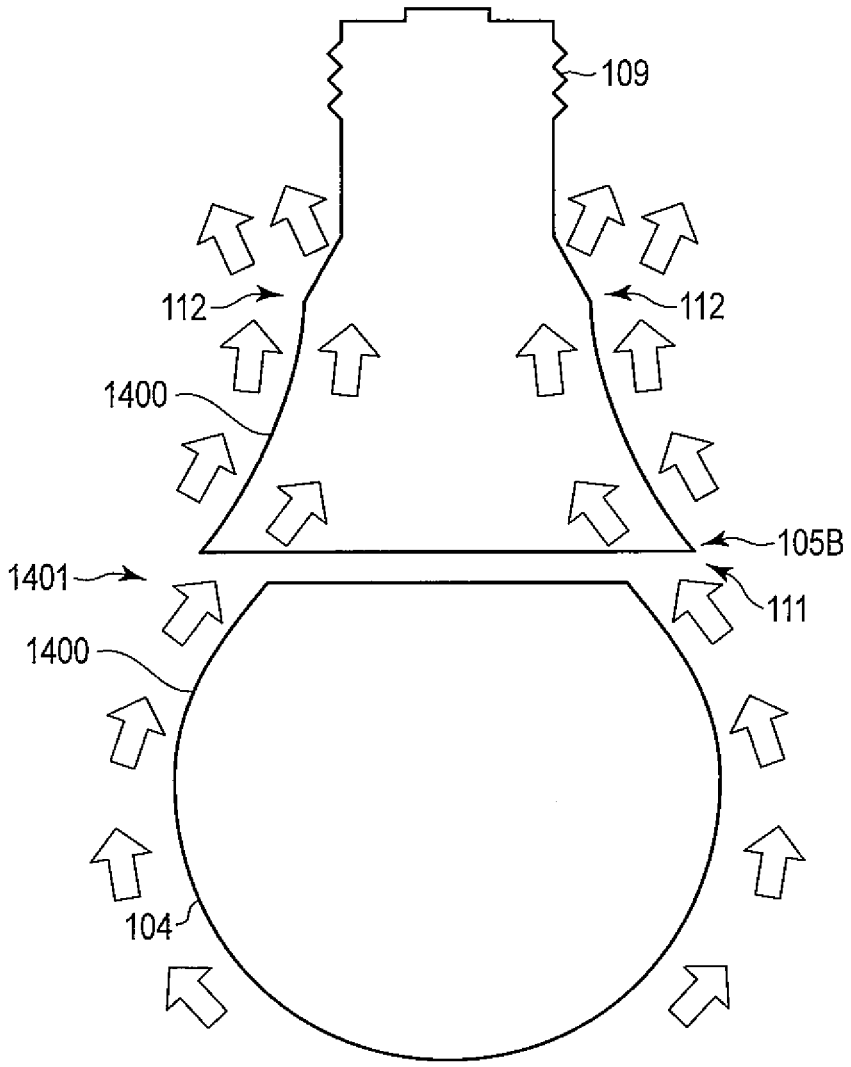
FIG. 14 is a schematic diagram of an external shape of the lighting apparatus illustrated in FIG. 9.

Next, airflow which changes according to the difference in external shape of the lighting apparatus is explained with reference to FIG. 12, FIG. 13, and FIG. 14. FIG. 12 is a schematic diagram illustrating an external shape of the lighting apparatus 800 illustrated in FIG. 8, FIG. 13 is a schematic diagram illustrating an external shape of the lighting apparatus 100 illustrated in FIG. 1, and FIG. 14 is a schematic diagram illustrating an external shape of the lighting apparatus 900 illustrated in FIG. 9. In the following explanation, suppose that the lighting apparatus is set in a state where the cap is located on the upper side.

As illustrated in FIG. 12, when the lower end part 105B of the radiator 105 has almost the same external diameter as the external diameter of the base 801, an envelope surface (indicated by a line in FIG. 12) 1200 which is formed of the globe 104, the base 801, and the radiator 105 is a smooth curved surface. When the envelope surface 1200 is a smooth curved surface, the air which rises along the external surface of the globe 104 is not easily introduced into the internal channel of the radiator 105 through the opening parts 111 on the globe 104 side, but tends to rise along the external surface of the radiator 105, as indicated by arrows in FIG. 12.

As illustrated in FIG. 13, when the lower end part 105B of the radiator 105 has an external diameter which is larger than the external diameter of the base 103, an envelope surface (which is indicated by a line in FIG. 13) 1300 which is formed of the globe 104, the base 103, and the radiator 105 has a stepped part 1301. When the envelope surface 1300 has the stepped part 1301, the air which rises along the external surface of the globe 104 is introduced into the internal channel of the radiator 105 through the opening parts 111 located on the globe 104 side, without nearly changing its moving direction, as indicated by arrows in FIG. 13. Therefore, the flow rate of the air which circulates through the internal channel of the radiator 105 is increased, and thermal radiation is promoted.

The external shape illustrated in FIG. 14 is almost the same as the external shape illustrated in FIG. 13, and an envelope surface (indicated by a line in FIG. 14) 1400 which is formed of the globe 104, the base 801, and the radiator 105 has a stepped part 1401. When the envelope surface 1400 has the stepped part 1401, the air which rises along the external surface of the globe 104 is introduced into the internal channel of the radiator 105 through the opening parts 111 located on the globe 104 side, without nearly changing its moving direction, as indicated by arrows in FIG. 14. Therefore, the flow rate of the air which circulates through the internal channel of the radiator 105 is increased, and thermal radiation is promoted.

(Third Embodiment)

Figure 15:
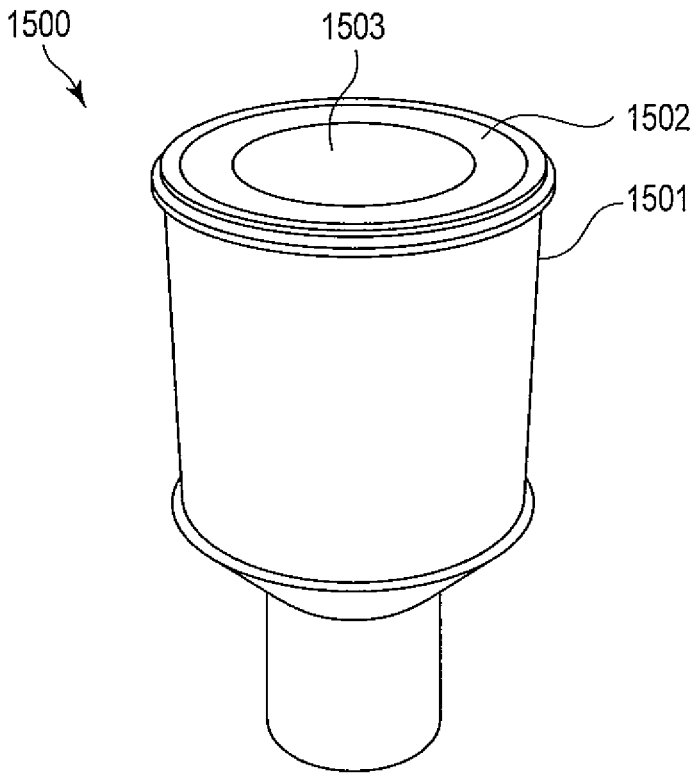
FIG. 15 is a schematic perspective view of a suction nozzle according to a third embodiment.
Figure 16A:
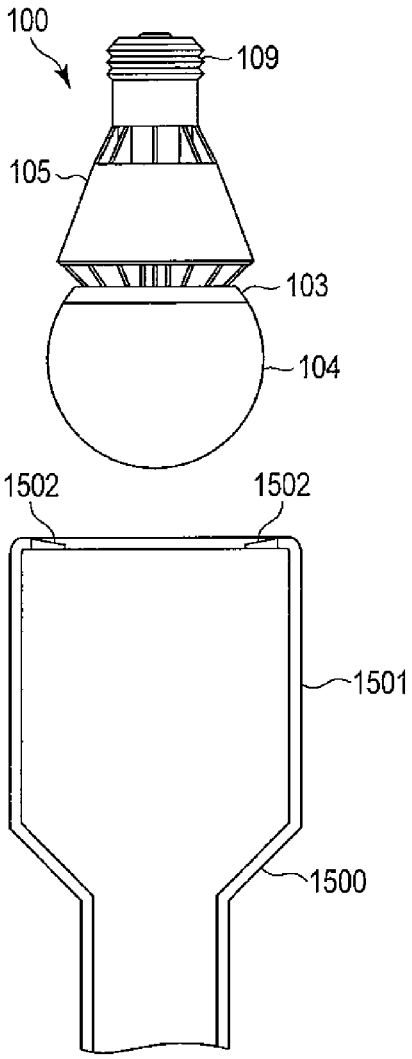
FIG. 16A is a diagram illustrating a state before the suction nozzle of FIG. 15 is fitted onto the lighting apparatus of FIG. 1.
Figure 16B:
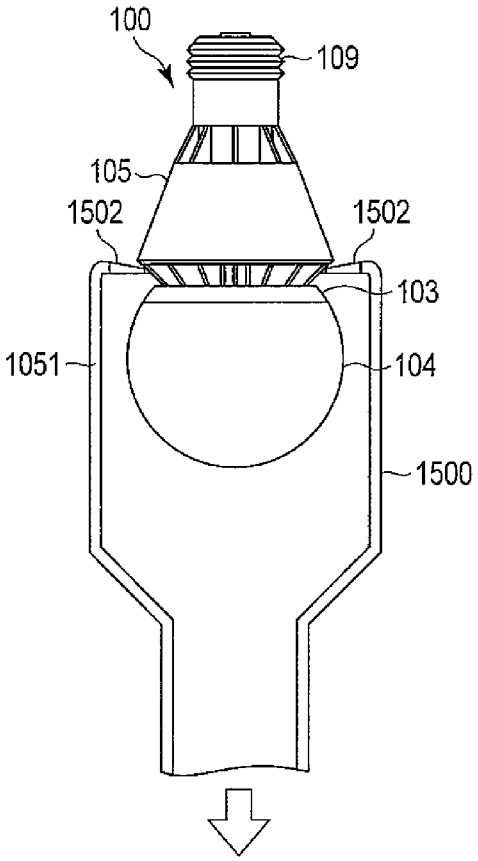
FIG. 16B is a diagram illustrating positions of the lighting apparatus of FIG. 1 and the suction nozzle of FIG. 15 in cleaning.

In a third embodiment, explained is a method of removing dirt and dust which accumulate in the internal channel 160 of the radiator 105 of the lighting apparatus 100 illustrated in FIG. 1, with reference to FIG. 15, FIG. 16A and FIG. 16B. FIG. 15 schematically illustrates a suction nozzle 1500 which is connected to a main body of a vacuum cleaner (not shown)

through a hose. The suction nozzle 1500 comprises a nozzle main body 1501 made of plastic, and a doughnut-shaped rubber sheet 1502 which is attached to a suction port of the nozzle main body 1501. An opening part 1503 of the rubber sheet 1502 is formed to have a diameter which is slightly smaller than the external diameter of the radiator 105. As illustrated in FIG. 16A, the suction nozzle 1500 is brought close to the lighting apparatus 100 in a state where the central axis of the suction nozzle 1500 almost agrees with the central axis of the lighting apparatus 100. Then, the suction nozzle 1500 is fitted onto the lighting apparatus 100 until the rubber sheet 1502 contacts the lower end part 105B of the radiator 105, as illustrated in FIG. 16B. Thereafter, the vacuum cleaner is operated, and caused to suck dirt and dust accumulating in the internal channel 160 of the radiator 105 by vacuum force. As described above, dirt and dust can be removed without detaching the lighting apparatus 100 from the socket, and thermally radiative performance of the lighting apparatus 100 can be maintained for a long time by periodically removing dirt and dust. Such removal of dirt and dust can be performed since the radiator 105 projects outward.

(Fourth Embodiment)

Figure 17:
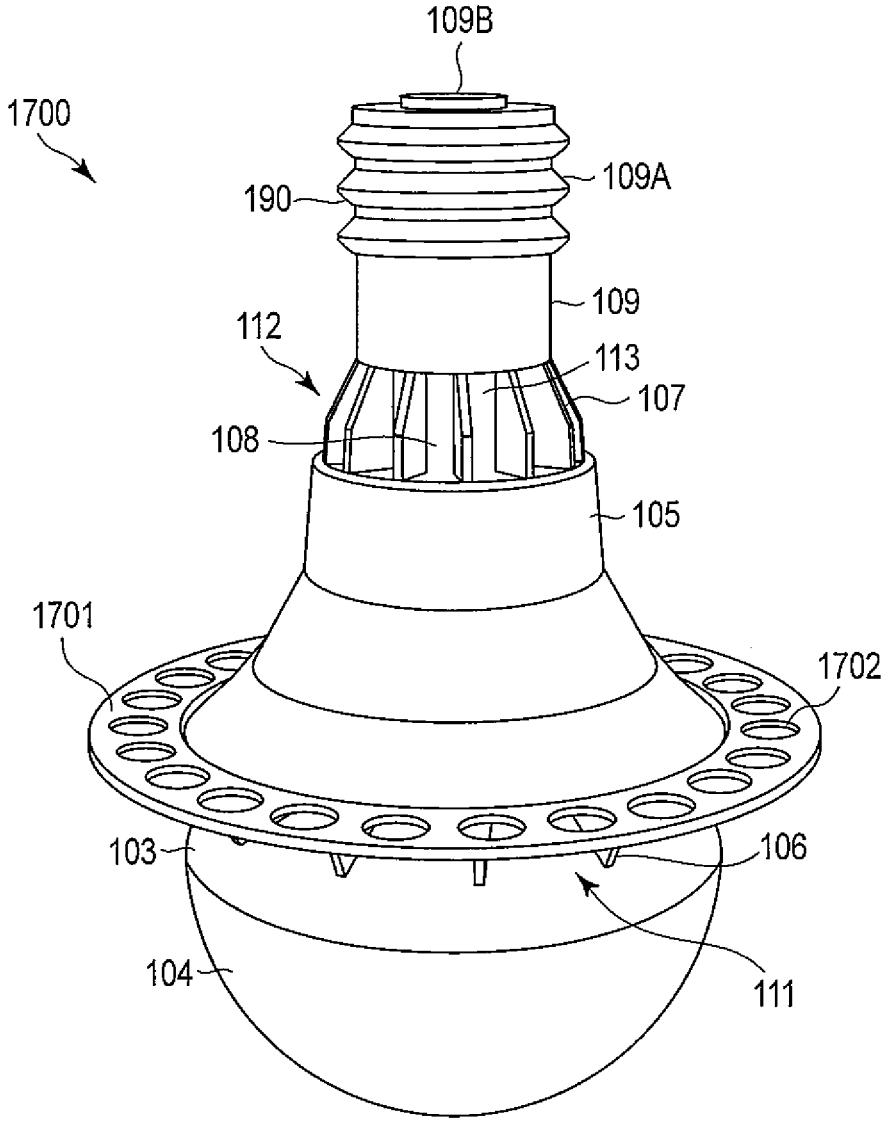
FIG. 17 is a schematic perspective view of a lighting apparatus according to a fourth embodiment.

FIG. 17 schematically illustrates a lighting apparatus 1700 according to a fourth embodiment. The lighting apparatus 1700 in FIG. 17 has the same structure as that of the lighting apparatus 100 in FIG. 1, and is different from the lighting apparatus 100 of FIG. 1 in that a brim 1701 is attached along an external circumferential surface of a radiator 105. The brim 1701 is provided to project outward from the radiator 105, and used for cleaning of the internal channel 160 of the radiator 105. The brim 1701 is provided with a plurality of holes 1702 in order not to prevent a natural convection current which is produced along the external surface of the radiator 105.

Figure 18:
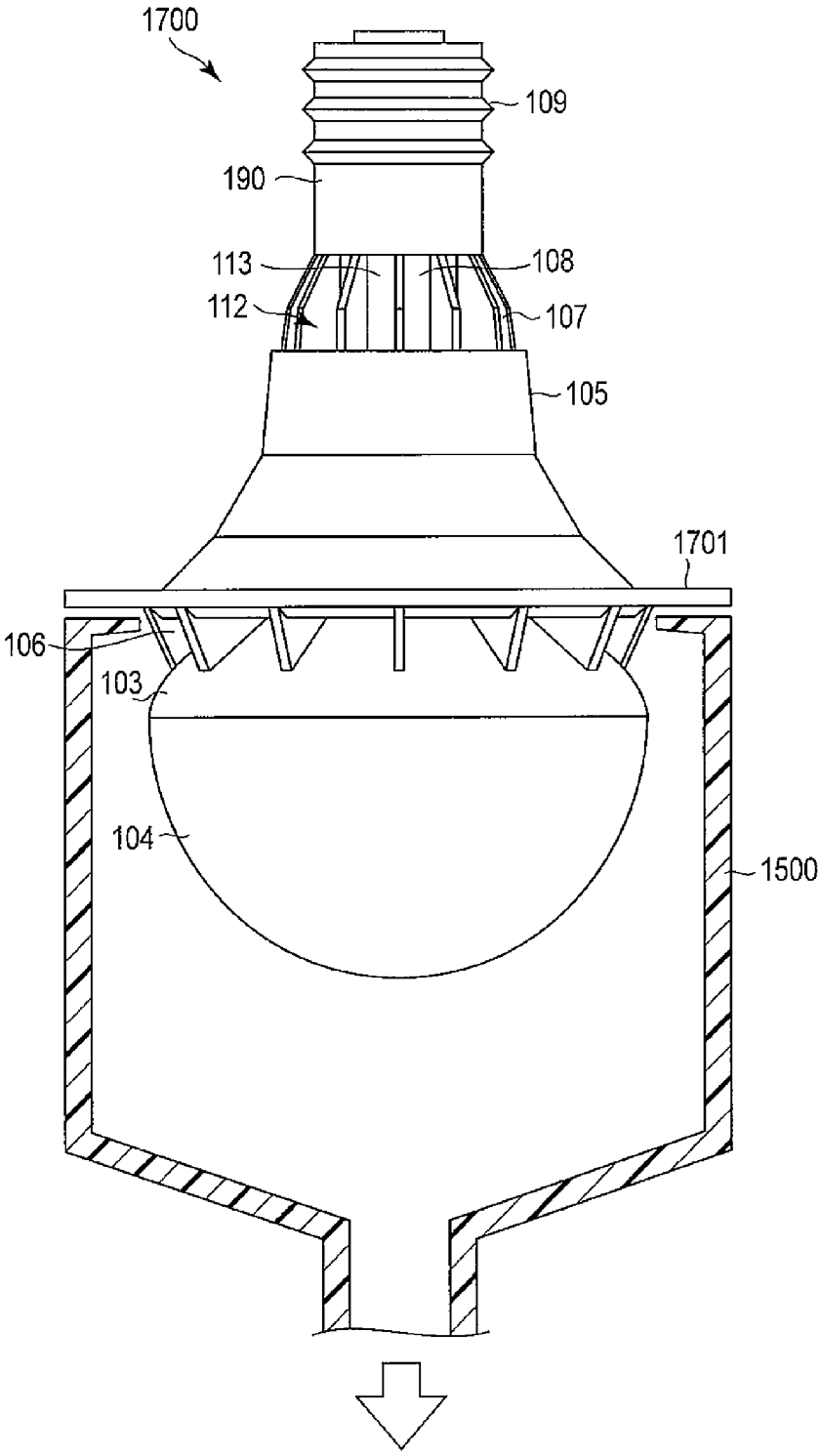
FIG. 18 is a schematic diagram illustrating a state where the suction nozzle of FIG. 15 is fitted onto the lighting apparatus of FIG. 17.

As illustrated in FIG. 18, the brim 1701 functions as a guide which is used when the suction nozzle 1500 illustrated in FIG. 15 is fitted onto the lighting apparatus 1700, and prevents the suction nozzle 1500 from being fitted deeper than required. When the distal end of the suction nozzle 1500 contacts the brim 1701, the suction nozzle 1500 cannot be putted forward any more, and the suction nozzle 1500 is properly positioned. As described above, the radiator 105 is provided with the brim 1701, and thereby cleaning can be performed more easily. When the radiator 105 is provided with the brim 1701, it is unnecessary to provide the suction port of the suction nozzle 1500 with the rubber sheet 1502, and the whole suction nozzle 1500 can be formed of a material which is harder than rubber, such as plastic.

In addition, by forming the brim 1701 of a material which has high thermal conductivity, such as metal, the thermally radiative area is increased, and thereby the thermally radiative performance can be improved. The brim 1701 may be integrally formed with the radiator 105.

(Fifth Embodiment)

Figure 19:
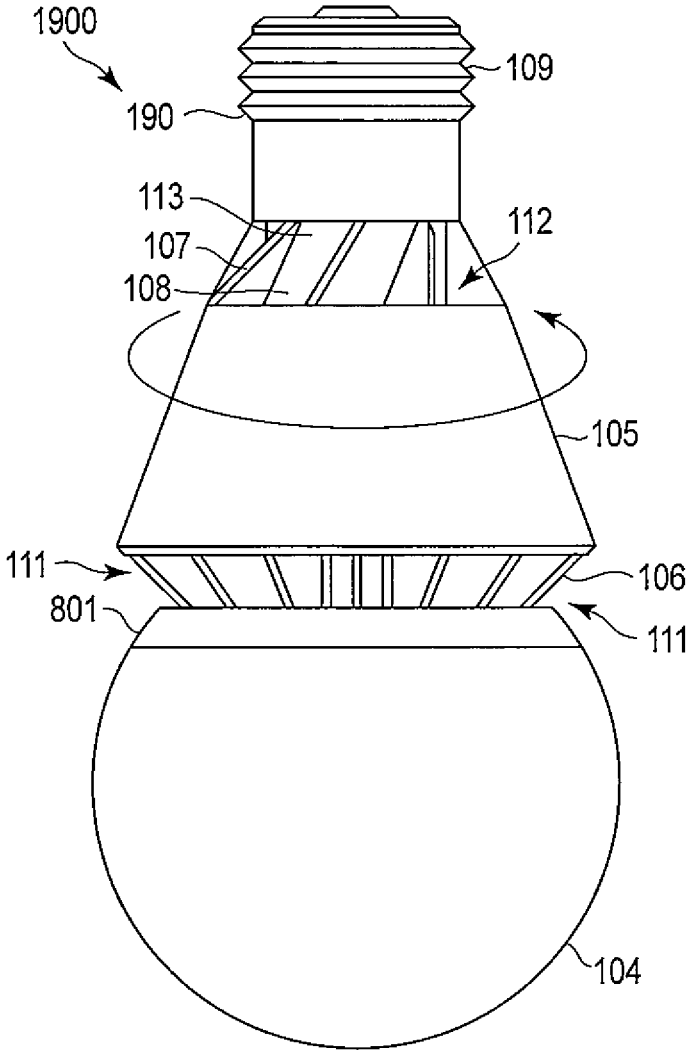
FIG. 19 is a schematic front view of a lighting apparatus according to a fifth embodiment.

FIG. 19 schematically illustrates a lighting apparatus 1900 according to a fifth embodiment. The lighting apparatus 1900 in FIG. 19 has almost the same structure as that of the lighting apparatus 100 in FIG. 1, and is different from the lighting apparatus 100 in the orientation of the spacers 107 which connect the cap part 190 with the radiator 105. Spacers 107 in FIG. 19 are arranged on the external circumferential surface of a housing case 113, and inclined in a direction in which force is applied when the lighting apparatus 1900 is screwed into a socket. In the present embodiment, when the lighting apparatus 1900 is screwed into a socket, the lighting apparatus 1900 is rotated in a direction indicated by an arrow illustrated in FIG. 19. By arranging the spacers 107 to be inclined in the direction in which force is applied when the lighting apparatus 1900 is screwed into a socket, force is applied not only in a direction of bending the plate-shaped spacers 107, but also a direction which runs along the surfaces of the spacers 107. Thereby, force which acts on a connecting part between the spacers 107 and the housing case 113 and a connecting part between the spacers 107 and the radiator 105 is reduced, and it is possible to prevent breakage of the connecting parts.

According to the lighting apparatus according to at least one of the above embodiments, the air is circulated through the inside of the cylindrical radiator, thereby the area of the thermally radiative surface can be increased, and the thermally radiative performance can be improved.

Although the above embodiments show the case where a cross section which is obtained by cutting the globe 104 and the radiator 105 by a plane that is vertical to the central axis of the lighting apparatus has a circular or annular shape, the cross section is not limited to the example having a circular or annular shape. For example, a globe which has an oval cross section may be used to obtain asymmetrical light distribution.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lighting apparatus comprising:

a board provided with a light emitting element to emit light;

a board attaching part having a first surface and a second surface, the board being attached to the first surface to be thermally connected to the board attaching part;

a globe provided on the board attaching part to cover the light emitting element and configured to transmit the light;

an exposed part attached to an edge part of the second surface to be thermally connected to the board attaching part, an enclosed space being formed by the globe and the exposed part, the enclosed space including a first space formed by the globe and the board attaching part and a second space formed by the board attaching part and the exposed part, the first space communicating with the second space through opening parts of the board attaching part;

a radiator provided to be apart from an external circumferential surface of the exposed part, the radiator having a first open end part nearer to the globe and a second open end part farther from the globe;

a rib attaching the exposed part to the radiator, a channel being provided between the exposed part and the radiator by the rib so that air flows into or out of the channel through the first and second open end parts; and a cap part attached to the radiator, the cap part being arranged opposite to the second open end part.

2. The apparatus according to claim 1, wherein an external diameter of the first open end part in a radial direction perpendicular to a central axis of the lighting apparatus is larger than an external diameter of one of the board attaching part and the globe in the radial direction.

3. The apparatus according to claim 1, wherein the the exposed part projects toward the cap part, and a position is distant from the central axis by a predetermined distance, the position being on the exposed part and closest to the cap part.

4. The apparatus according to claim 1, wherein an external circumferential surface of the radiator has a waved shape.

5. The apparatus according to claim 1, wherein the radiator is provided with one or more fins on at least one of an internal circumferential surface and an external circumferential surface of the radiator.

6. The apparatus according to claim 1, wherein the radiator is provided with one or more slits which extend along a direction of the central axis.

7. The apparatus according to claim 6, wherein the rib comprises one or more through-holes.

8. The apparatus according to claim 1, further comprising a spacer which attaches the radiator to the cap part.

9. The apparatus according to claim 1, wherein the radiator comprises a brim on an external circumferential surface of the radiator.

10. The apparatus according to claim 1, wherein at least one of the opening parts is disposed closer to the light emitting element than the other opening parts are.

11. A lighting apparatus comprising:

a board provided with a light emitting element to emit light;

a board attaching part having a first surface and a second surface, the board being attached to the first surface to be thermally connected to the base;

a globe provided on the board attaching part to cover the light emitting element and configured to transmit the light;

an exposed part attached to an edge part of the second surface to be thermally connected to the board attaching part, an enclosed space being formed by the globe and the exposed part, the enclosed space including a first space formed by the globe and the board attaching part and a second space formed by the board attaching part and the exposed part, the first space communicating with the second space through opening parts of the board attaching part;

a housing attached to the exposed part to be thermally connected to the board attaching part, the housing comprising a cylindrical radiator having a first end part and a second end part which are opened, the housing comprising one or more ribs which attach the radiator to the second surface, the first end part being arranged opposite to the second surface to provide a first opening between the first end part and the second surface, the radiator comprising one or more channels, the channels being partitioned by the radiator and the ribs and annularly provided inside the radiator; and a cap part attached to the housing, the cap part being arranged opposite to the second end part to provide a second opening part between the cap part and the second end part, an external diameter of the first end part of the radiator in the radial direction perpendicular to a central axis of the lighting apparatus and includes the first end part is larger than an external diameter of one of the base and the globe on the virtual plane such that air heated by the globe flows, by natural convection, upward into the first opening, through the one or more channels of the radiator, and out of the second opening at the cap part.

12. A lighting apparatus comprising:

a light emitting element to emit light;

a globe that extends downward along a central axis to cover the light emitting element and transmit the light;

a base comprising an attaching part and an exposed part, the light emitting element being attached to the attaching part, the exposed part having a dome-shaped part that projects upward along the central axis in a direction opposite to the globe, the exposed part being thermally connected to the light emitting element, the enclosed space including a first space formed by the globe and the attaching part and a second space formed by the attaching part and the exposed part, the first space communicating with the second space through opening parts of the attaching part;

a radiator spaced apart from the dome-shaped part by a rib to define an internal channel between an exterior surface of the dome-shaped part and an interior surface of the radiator;

a first opening part to the internal channel that is proximate the globe so that air that is heated by an external surface of the globe rises upward along the central axis by natural convection into the internal channel;

a second opening part to the internal channel that is proximate a cap so that the air in the internal channel is discharged from the second opening part at the cap; and a stepped part that smoothly guides the air that is heated by the external surface of the globe into the internal channel.

13. The apparatus according to claim 12, wherein the globe has a diameter that is gradually increased from an edge part connected to the exposed part toward a maximum diameter part, and gradually reduced from the maximum diameter part toward an end part, the first opening part being located above the maximum diameter part so that the air that is heated by the external surface of the globe at the edge part has a velocity component in a direction toward the central axis to introduce the air into the internal channel without the radiator blocking the light from the globe.

14. The apparatus according to claim 1, wherein the globe includes a maximum diameter part in which an external diameter of the globe in the radial direction is maximum, and the first open end part is located between the cap part and the maximum diameter part.

* * * * *